US010391650B2

(12) United States Patent
Schmitt et al.

(10) Patent No.: US 10,391,650 B2
(45) Date of Patent: Aug. 27, 2019

(54) HAIR GROOMING APPLIANCE

(71) Applicant: Spectrum Brands, Inc., Middleton, WI (US)

(72) Inventors: Paul Allen Schmitt, Madison, WI (US); Long Quan, Guangzhou (CN); John Y.M. Wong, Hong Kong (CN)

(73) Assignee: Spectrum Brands, Inc., Middleton, WI (US)

( * ) Notice: Subject to any disclaimer, the term of this patent is extended or adjusted under 35 U.S.C. 154(b) by 211 days.

(21) Appl. No.: 15/341,105

(22) Filed: Nov. 2, 2016

(65) Prior Publication Data

US 2017/0120467 A1 May 4, 2017

Related U.S. Application Data

(60) Provisional application No. 62/250,396, filed on Nov. 3, 2015.

(51) Int. Cl.
*B26B 19/38* (2006.01)
*B26B 19/12* (2006.01)

(52) U.S. Cl.
CPC ..... *B26B 19/386* (2013.01); *B26B 19/12* (2013.01)

(58) Field of Classification Search
CPC ..... B26B 19/02–042; B26B 19/046; B26B 19/048; B26B 19/063; B26B 19/10; B26B 19/102; B26B 19/12; B26B 19/14; B26B 19/146; B26B 19/28; B26B 19/288; B26B 19/38; B26B 19/3813; B26B 19/3846–3866; B26B 19/38866; B26B 19/3893; A45D 2026/0095
USPC ..... 30/43.4–45
See application file for complete search history.

(56) References Cited

U.S. PATENT DOCUMENTS 3,106,775 A 10/1963 Lew
3,421,215 A 1/1969 Bauer
3,967,372 A 7/1976 Beck et al.
3,967,374 A * 7/1976 Boiten ..... B26B 19/04 30/43.92

(Continued)

FOREIGN PATENT DOCUMENTS

WO WO-2017079199 A1 * 5/2017

OTHER PUBLICATIONS

International Search Report and written opinion for PCT/US 16/59990, dated Mar. 16, 2017, 11 pages.

*Primary Examiner* — Jason Daniel Prone
(74) *Attorney, Agent, or Firm* — Armstrong Teasdale LLP

(57) ABSTRACT

In a hair grooming appliance, a head is detachably mountable on a handle having a motor and a receptacle configured to receive at least a portion of the head therein when the head is mounted on the handle with the head in operative connection with the motor. The handle has a first attachment member positioned at least partially within the receptacle and arranged to detachably engage the head when the at least a portion of the head is inserted into the receptacle and a second attachment member positioned at least partially within the receptacle and arranged to engage the head when the at least a portion of the head is inserted into the receptacle. The second attachment member is a different type of attachment member than the first attachment member. In a particular embodiment, the hair grooming appliance is a shaver.

12 Claims, 22 Drawing Sheets

(56) References Cited

U.S. PATENT DOCUMENTS 4,038,747 A * 8/1977 Upton ..... B26B 19/26 30/34.2
4,089,110 A * 5/1978 Rasco ..... B26B 19/44 30/43.6
4,233,733 A * 11/1980 Gallanis ..... B26B 19/10 30/43.92
4,642,892 A * 2/1987 Ishida ..... B26B 21/38 30/44
4,910,869 A * 3/1990 Labrijn ..... B26B 19/14 30/43.6
4,993,152 A * 2/1991 Deubler ..... B26B 19/04 30/43.92
5,544,415 A * 8/1996 Huang ..... B26B 19/06 30/43.92
6,354,005 B1 * 3/2002 Bosch ..... B26B 19/14 30/43.6
6,886,255 B2 * 5/2005 Freas ..... B26B 19/06 30/43.91
7,350,300 B2 * 4/2008 Yamaguchi ..... B26B 19/048 30/43.92
7,426,785 B2 * 9/2008 Ho ..... B26B 19/265 30/43.92
7,472,483 B2 * 1/2009 Beugels ..... B26B 19/063 30/43.4
7,490,409 B2 * 2/2009 Oh ..... B26B 19/04 30/43.92
8,079,149 B2 * 12/2011 Bednar ..... B26B 19/02 30/44
8,677,627 B2 * 3/2014 Li ..... B26B 19/04 30/43.91
2005/0198827 A1 * 9/2005 Andrew ..... B26B 19/04 30/43.6
2007/0033806 A1 * 2/2007 Orloff ..... B26B 21/52 30/43.4
2007/0056166 A1 * 3/2007 Shiba ..... B26B 19/04 30/44
2008/0034591 A1 2/2008 Fung
2008/0060202 A1 * 3/2008 Oh ..... B26B 19/16 30/43.6
2008/0294176 A1 * 11/2008 Hashiguchi ..... A45D 26/0028 30/43.5
2009/0025229 A1 1/2009 Kappes et al.
2010/0275446 A1 11/2010 Schmitt et al.
2013/0152399 A1 * 6/2013 Park ..... B26B 19/14 30/42
2013/0160296 A1 * 6/2013 Park ..... B26B 21/38 30/42
2014/0196292 A1 7/2014 Schmitt
2015/0089814 A1 * 4/2015 Marut ..... F16C 11/10 30/42

* cited by examiner

HAIR GROOMING APPLIANCE

CROSS-REFERENCE TO RELATED APPLICATIONS

This application claims priority to Provisional Patent Application Ser. No. 62/250,396, filed on Nov. 3, 2015, which is incorporated herein by reference in its entirety.

BACKGROUND

The present invention relates generally to hair grooming appliances and, more particularly, to handheld electric hair grooming appliances with detachable heads.

Conventional electric hair grooming appliances typically include a handle and a working head detachably mounted on the handle. When using these conventional appliances, the user may experience difficulty in properly aligning and attaching the head onto the handle. It has also been known in some hair grooming appliances for the head to become inadvertently detached from the handle. It would be useful, therefore, to provide a grooming appliance with improved ease of attachment of the head to the handle and reduced risk of inadvertent detachment of the head therefrom.

SUMMARY

In one embodiment, a hair grooming appliance generally comprises a head and a handle for detachably mounting the head thereon. The handle includes a motor and a receptacle configured to receive at least a portion of the head therein when the head is mounted on the handle, with the head being configured to be in operative connection with the motor when the head is mounted on the handle. The handle has a first attachment member positioned at least partially within the receptacle and arranged to detachably engage the head when the at least a portion of the head is inserted into the receptacle and a second attachment member positioned at least partially within the receptacle and arranged to engage the head when the at least a portion of the head is inserted into the receptacle. The second attachment member is a different type of attachment member than the first attachment member.

In another embodiment, a grooming appliance generally comprises a head including a base and a grooming device mounted on the base. The base includes a neck and a skirt formed integrally with the neck, with the skirt at least partially circumferentially surrounding the neck in spaced relationship therewith. The head is detachably mountable on a handle. The handle includes a motor and a receptacle configured to receive the neck therein when the handle is mounted on the head, with the head being operatively connected to the motor when the head is mounted on the handle. The handle has an end against which the skirt is seated when the neck is inserted into the receptacle whereby the neck is enclosed within the receptacle when the handle is mounted on the head.

In another embodiment, a handheld electric shaver generally comprises a head having at least one outer cutter defining a skin-contacting plane of the shaver, and a head axis oriented substantially perpendicular to the skin-contacting plane of the shaver. The head includes at least one inner cutter moveable relative to the outer cutter in operation of the shaver. The head is detachably mountable on a handle having a motor, a drive shaft operatively connected to the motor and defining a drive shaft axis, and a receptable configured to receive at least a portion of the head therein upon mounting the head on the handle such that the drive shaft protrudes into the receptacle for operative connection with the at least one inner cutter of the head. The handle and the head are configured relative to each other such that the head is insertable into the receptacle along an insertion direction wherein the insertion direction is substantially parallel to the head axis and oblique relative to the drive shaft axis.

BRIEF DESCRIPTION OF THE DRAWINGS

Corresponding reference characters indicate corresponding parts throughout the several views of the drawings.

DETAILED DESCRIPTION

Figure 1:
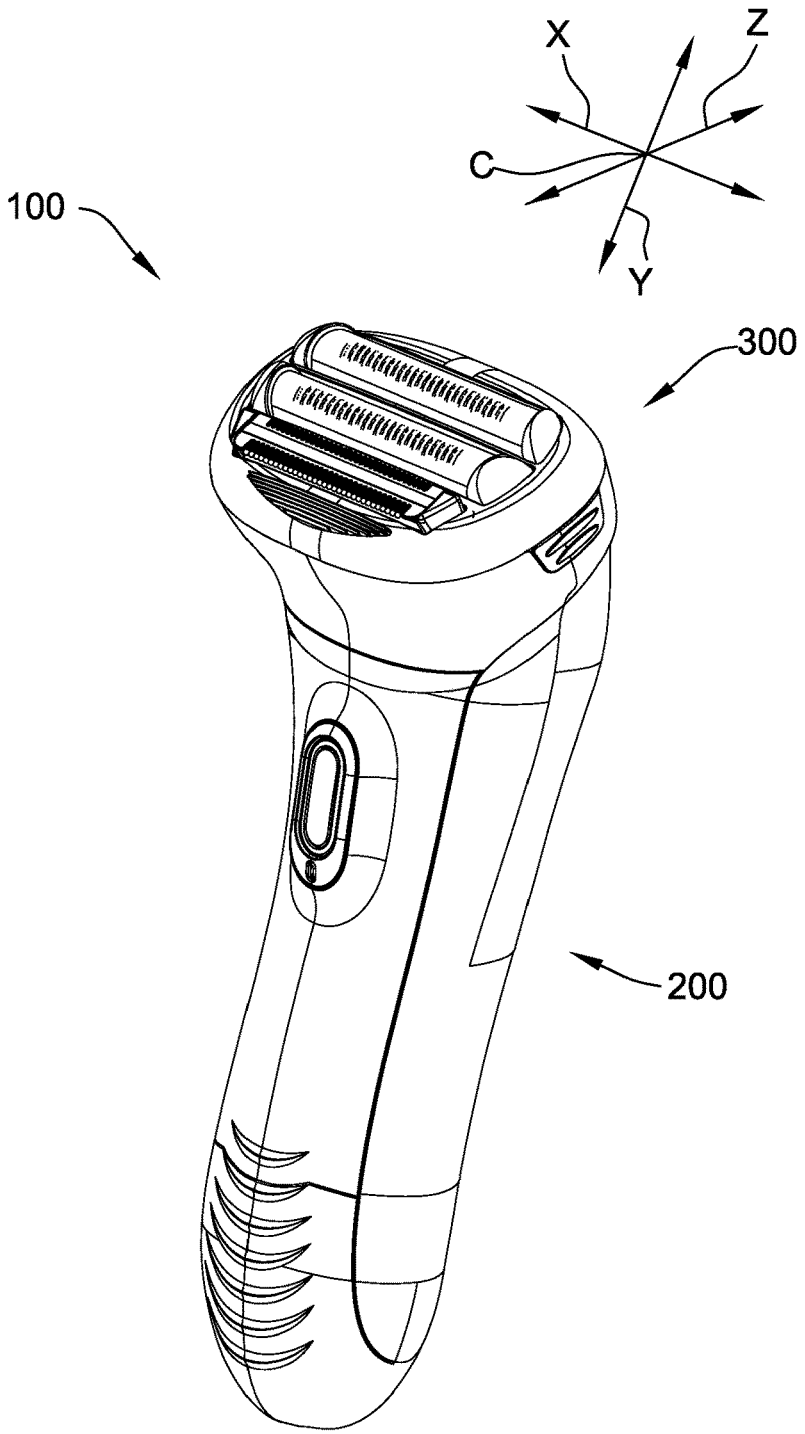
FIG. 1 is a front perspective view of one embodiment of a grooming appliance.
Figure 2:
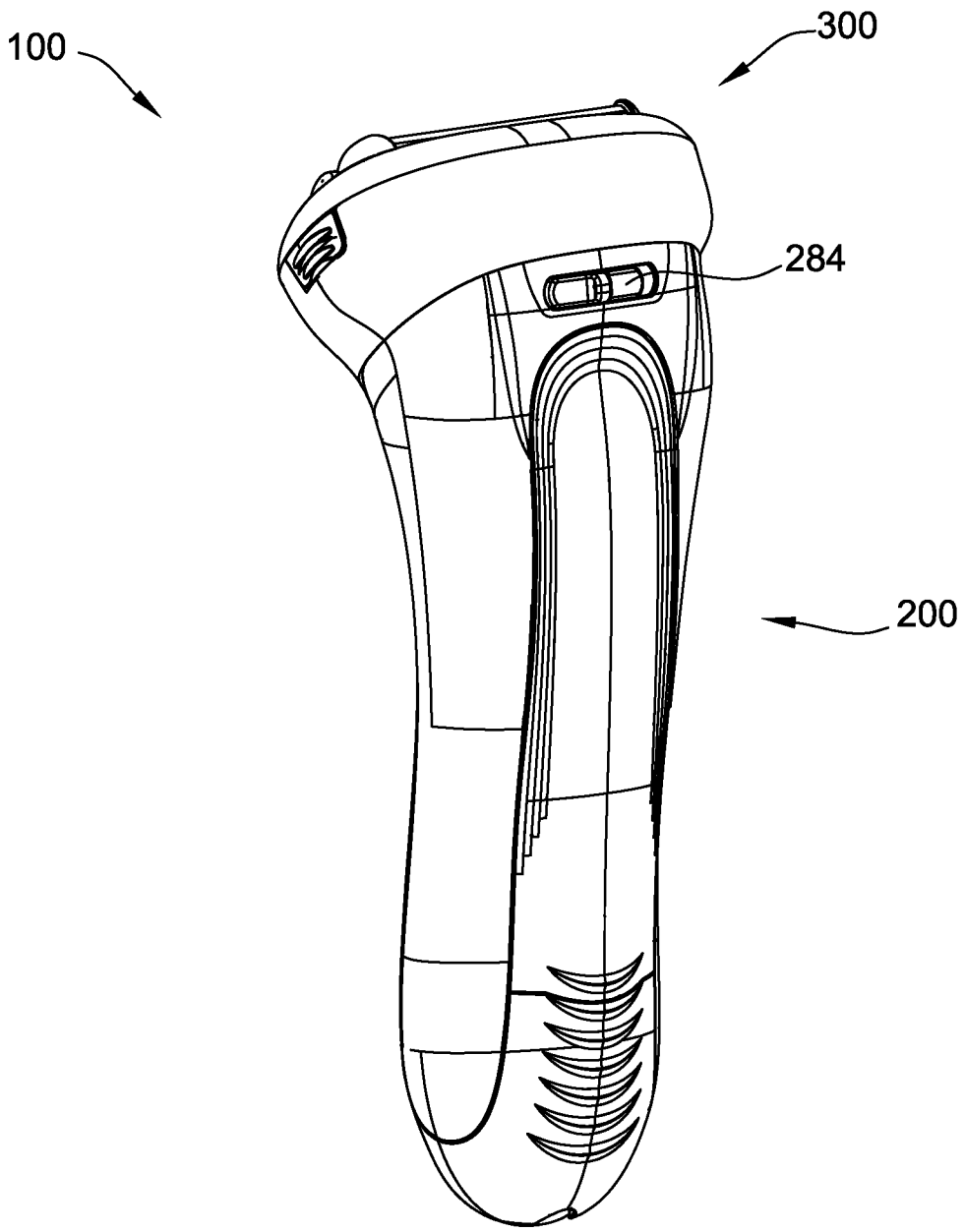
FIG. 2 is a back perspective view of the grooming appliance of FIG. 1.
Figure 3:
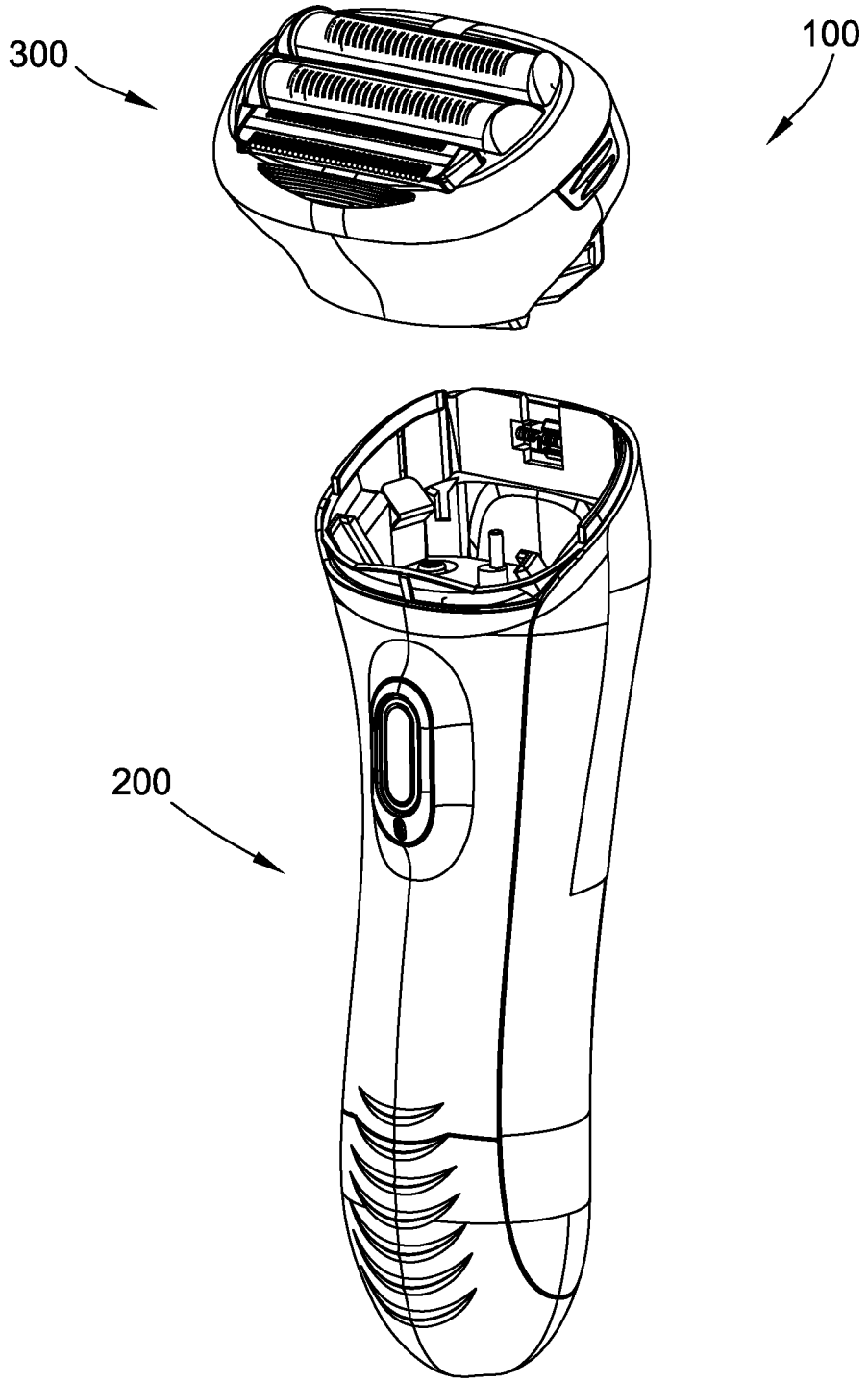
FIG. 3 is an exploded view the grooming appliance of FIG. 1.

Referring now to the drawings, and in particular to FIGS. 1-3, a handheld electric grooming appliance according to one embodiment is indicated generally at the reference numeral 100 in the form of an oscillating shaver (commonly referred to as a "foil shaver") used for removing hair from one's skin. It is understood, however, that aspects of the shaver 100 may also be incorporated in other suitable handheld electric grooming appliances (e.g., hair removal appliances such as rotary shavers, epilators, clippers, etc.) without departing from the scope of this invention.

The illustrated shaver 100 includes a handle (generally indicated at 200) and a head (generally indicated at 300) detachably mounted on the handle 200. The shaver 100 has a width dimension X, a height dimension Y, and a depth dimension Z. These dimensions share a center C and collectively define a three-dimensional space partially occupied by the shaver 100. As used herein, the terms "side," "inside," "outside," and any variations thereof are directional modifiers indicating a disposition relative to the center C in the dimension X. The terms "top," "upper," "upward," "above," "bottom," "lower," "downward," "beneath," and any variations thereof are directional modifiers indicating a disposition relative to the center C in the dimension Y. The terms "front," "forward," "rear," "back," "backward," and any variations thereof are directional modifiers indicating a disposition relative to the center C in the dimension Z.

Referring now to FIG. 4-12, the illustrated handle 200 has a core (generally indicated at 202) and a shell (generally indicated at 204) that surrounds at least a heightwise segment of the core 202 to facilitate defining an interior compartment 206 (shown in FIG. 6) of the shell 204, in which at least part of the core 202 is enclosed and shielded from environmental conditions such as, for example, liquid and particulate matter. The core 202 includes a chassis 208 carrying electrical components of the shaver 100, such as the drive structure (e.g., the motor 210), the power structure (e.g., the battery 212), and the control structure (e.g., the printed circuit board 214) that are substantially sealed within the interior compartment 206.

Any suitable user interface may be provided for interacting with the control structure (e.g., a power button 220 may be accessible on the exterior of the shell 204), and any suitable terminal(s) may be provided for connecting the power structure to an external power source (e.g., a pair of charge pins 222 or terminals may be accessible on the exterior of the core 202 and/or the shell 204). Alternatively, the handle 200 may not have a separate core 202 (or chassis 208) which carries electrical components of the shaver 100 but, instead, the core 202 and the shell 204 may be integrally molded as a single, unitary structure that suitably carries the electrical components of the shaver 100.

Figure 6:
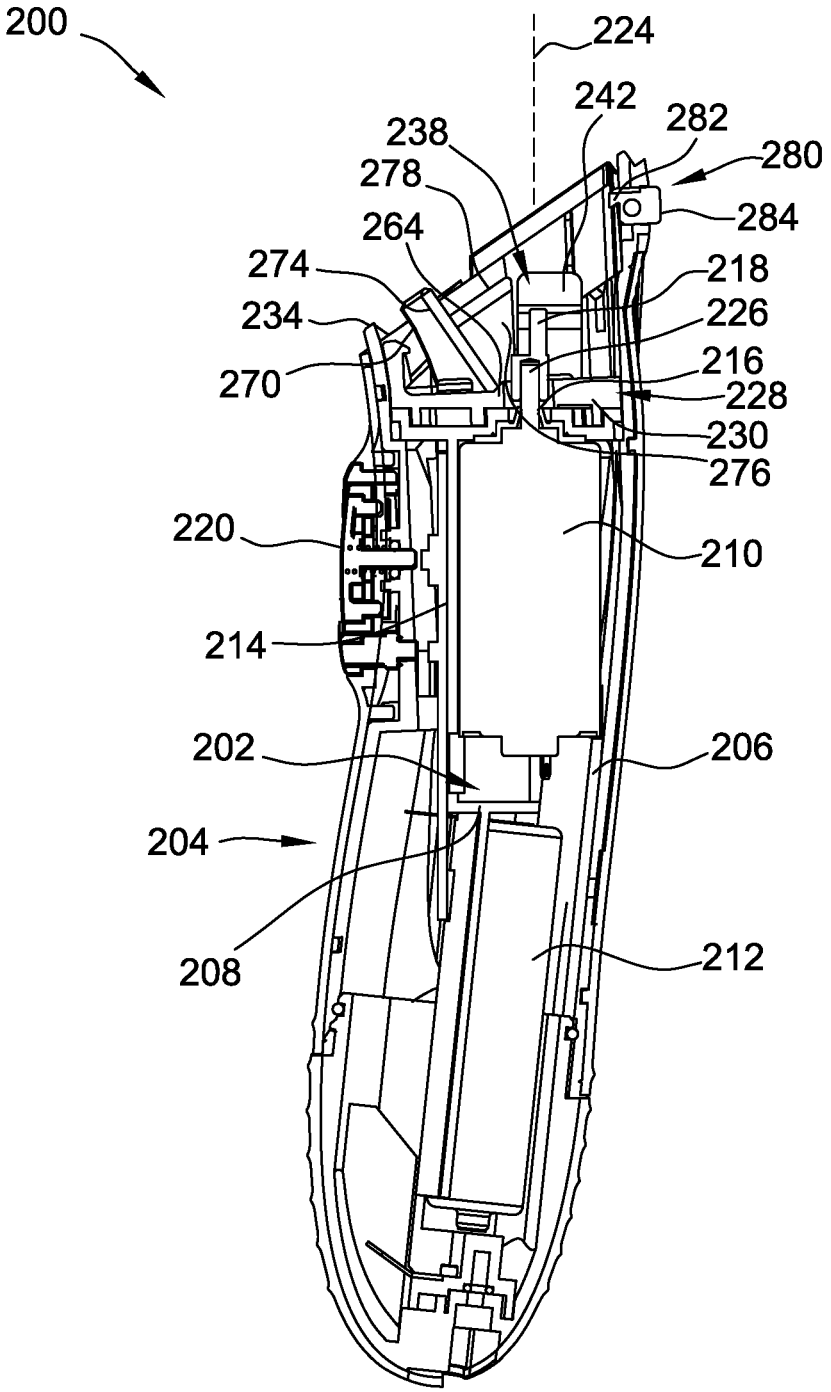
FIG. 6 is a sectional view of the handle of FIG. 4.

As shown in FIG. 6, the drive shaft 216 of the illustrated motor 210 is a rotating drive shaft that extends (e.g., protrudes from the interior compartment 206) along a drive shaft axis 224 and has an eccentric pin 218 at its tip 226. In other embodiments, however, the drive shaft 216 may have any suitable construction that facilitates operating the shaver 100 in the manner described herein (e.g., the drive shaft 216 may translate back-and-forth, rather than rotate, such that the motor 210 may be a linear-type motor rather than a rotating-type motor).

The illustrated handle 200 also includes a support wall (generally indicated at 228) through which the drive shaft 216 of the motor 210 protrudes out of the interior compartment 206 along the drive shaft axis 224. The support wall 228 has a top panel 230 and a bottom panel 232, and the support wall 228 is recessed relative to an end (e.g., an annular end 234) of the handle 200 so as to define a receptacle 236 into which the drive shaft 216 protrudes. While the support wall 228 is a constituent part of the core 202 in the illustrated embodiment, the support wall 228 may suitably be a constituent part of the shell 204 in other embodiments. Either way, the support wall 228 serves as a partition between the receptacle 236 and the interior compartment 206. Optionally, one or more gaskets may be provided within the receptacle 236 (e.g., around the dive shaft 216 at its interface with the support wall 228) to facilitate sealing the interior compartment 206 against infiltration by liquid and/or particulate matter. In other embodiments, the top panel 230 and the bottom panel 232 of the support wall 228 may be integrally molded together as a single, unitary structure, rather than being separately molded and attached to one another as shown.

In the illustrated embodiment, a retainer clip (generally indicated at 238) is fixed between the top panel 230 and the bottom panel 232 via a plurality of screws 240 that fasten the top panel 230 onto the bottom panel 232. The retainer clip 238 has a pair of resiliently flexible clip arms 242 connected by, and projecting from, a strip 244, such that the clip arms 242 are oriented substantially perpendicular to the strip 244 in a generally U-shaped manner. The strip 244 includes a plurality of locator features 246 that facilitate locating the strip 244 on the support wall 228 (e.g., between the top panel 230 and the bottom panel 232). Each of the clip arms 242 includes a proximal end 248, a distal end 250, and a body 252 extending from the proximal end 248 to the distal end 250. The body 252 has a detent segment 254 and a guide segment 256 that is closer to the respective distal end 250 than is the detent segment 254. Notably, in other embodiments, the retainer clip 238 (e.g., the clip arms 242) may be integrally molded with at least one panel 230, 232 of the support wall 228 as a single, unitary structure, rather than being separately molded and attached to the support wall 228 as shown.

The illustrated bottom panel 232 of the support wall 228 has a base 258 (shown in FIG. 8) and a pair of integrally formed tabs 260 each projecting from the base 258 near a side edge 262 of the base 258. The illustrated top panel 230 of the support wall 228 has: a base 264; a pair of opposing cutouts 266 (shown in FIG. 11) each defined in the base 264 near a side edge 268 of the base 264; a catch 270 integrally molded with and projecting from the base 264 near a forward edge 272 of the base 264; a pair of rails 274 each integrally molded with and projecting from the base 264 near one of the side edges 268 of the base 264; and a pair of wings 276 each integrally molded with and projecting from the base 264 near one of the side edges 268 of the base 264 such that each wing 276 is integrally molded together with a respective one of the rails 274. In some embodiments, the catch 270 may be a rigid structure (i.e., the catch 270 is not flexible in some embodiments). In other embodiments, the catch 270 may be resiliently flexible.

While the tabs 260 are described as being part of the bottom panel 232 in the illustrated embodiment, and while the cutouts 266, the catch 270, the rails 274, and the wings 276 are described as being part of the top panel 230 in the illustrated embodiment, it should be noted that the tabs 260, the cutouts 266, the catch 270, the rails 274, and the wings 276 are to be considered part of the support wall 228 generally. In other words, the support wall 228 may have any suitable quantity of panels arranged in any suitable manner such that the tabs 260, the cutouts 266, the catch 270, the rails 274, and the wings 276 may each be part of any one or more of the panels that make up the support wall 228.

In the illustrated embodiment, each of the rails 274 has a generally L-shaped cross-section and extends generally forward from the base 264 at an angle that is oblique relative to the base 264 and the drive shaft axis 224 when the handle 200 is viewed from the side, as shown in the cross-section of FIG. 6 for example. Moreover, each wing 276 has a face 278 which is oriented substantially perpendicular to its respective rail 274 and oblique relative to the drive shaft axis 224 such that each rail 274 and the face 278 of its associated wing 276 are oriented in opposingly oblique directions in relation to the base 264 and the drive shaft axis 224 when the handle 200 is viewed from the side, as shown in the cross-section of FIG. 6 for example. Alternatively, the rails 274 and the wings 276 may be configured in any suitable manner that facilitates enabling the rails 274 and the wings 276 to function as described herein.

Figure 7:
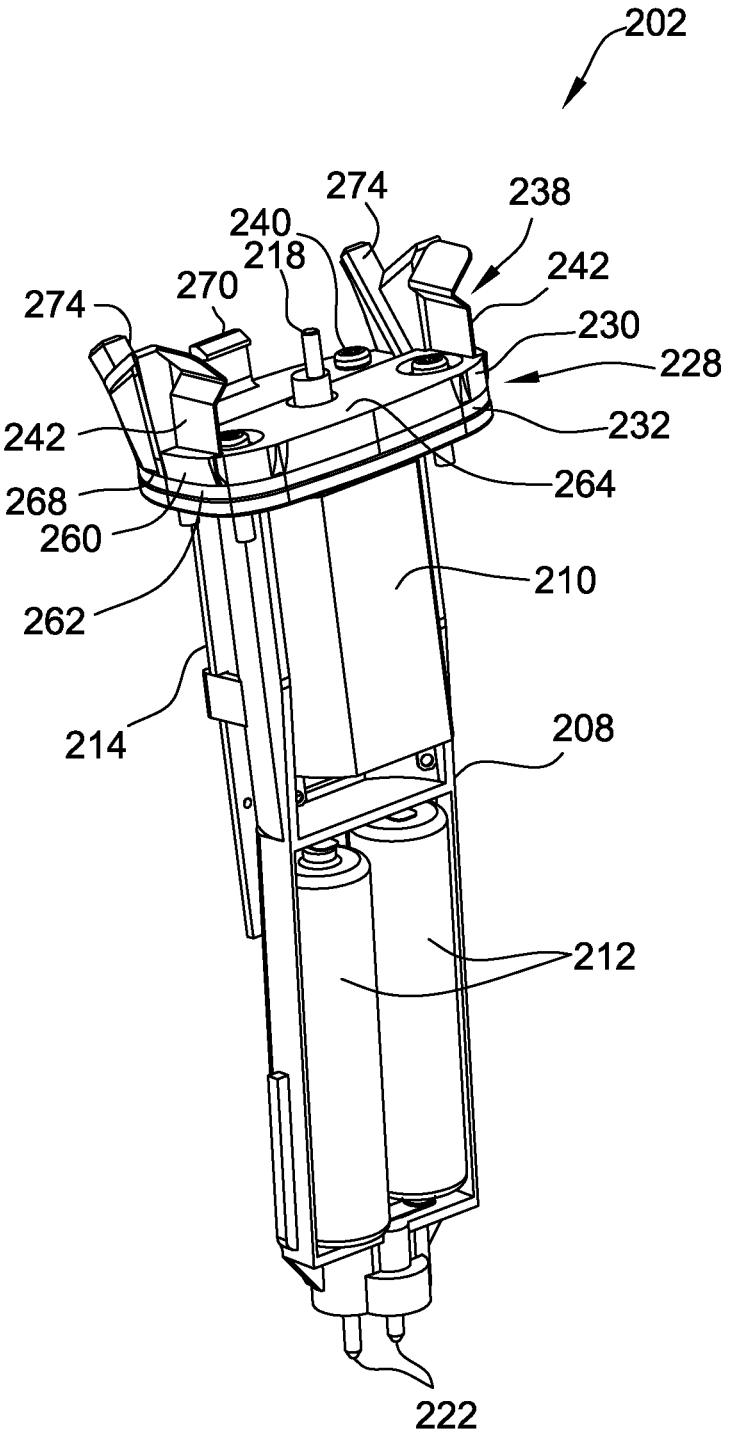
FIG. 7 is a perspective view of a core of the handle of FIG. 4.
Figure 8:
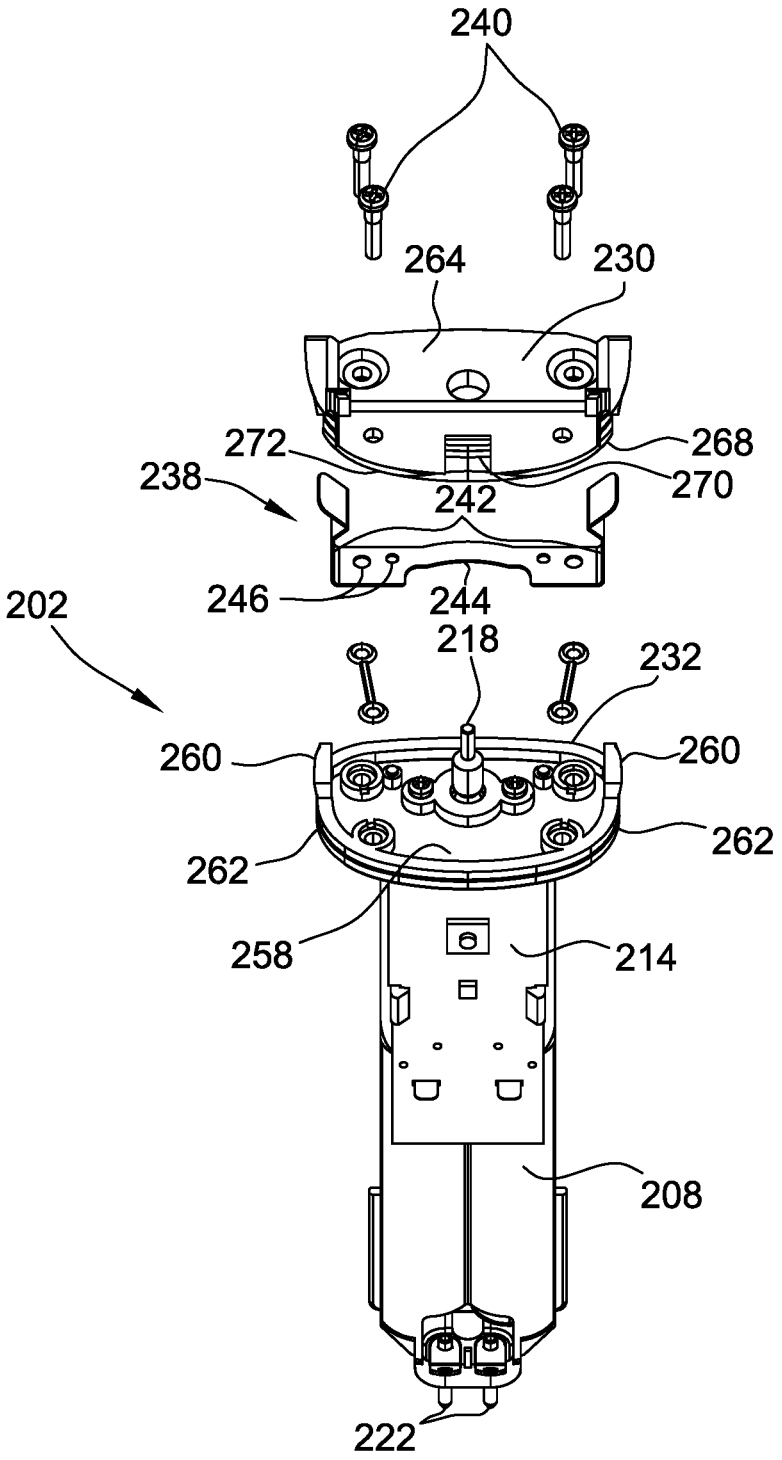
FIG. 8 is an exploded view of the core of FIG. 7.
Figure 9:
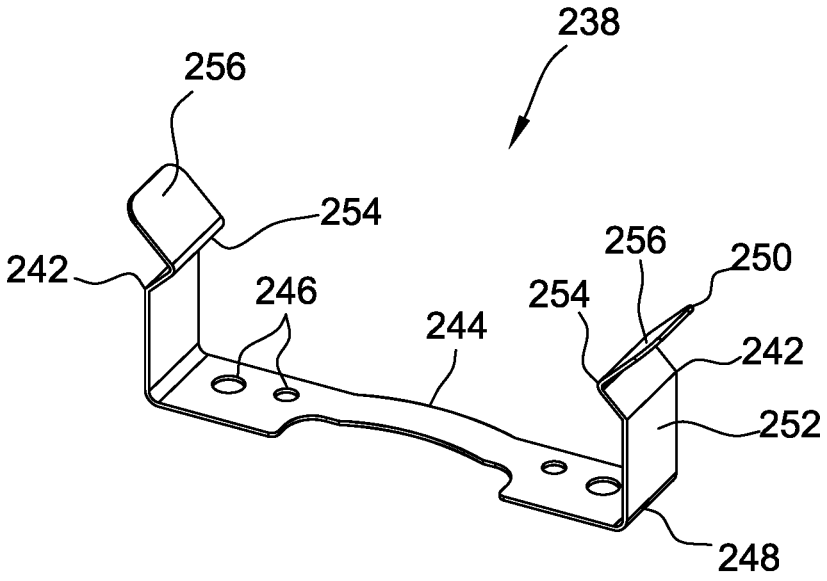
FIG. 9 is a perspective view of a retainer clip of the core of FIG. 7.
Figure 10:
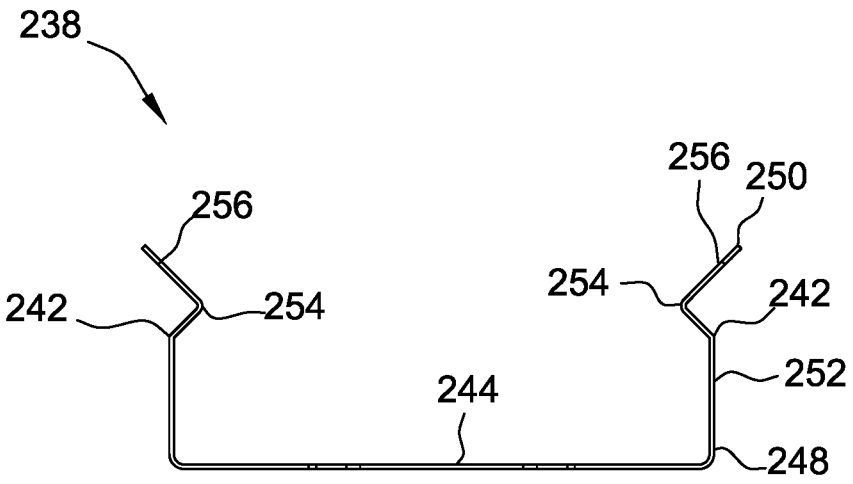
FIG. 10 is a side view of the retainer clip of FIG. 9.
Figure 11:
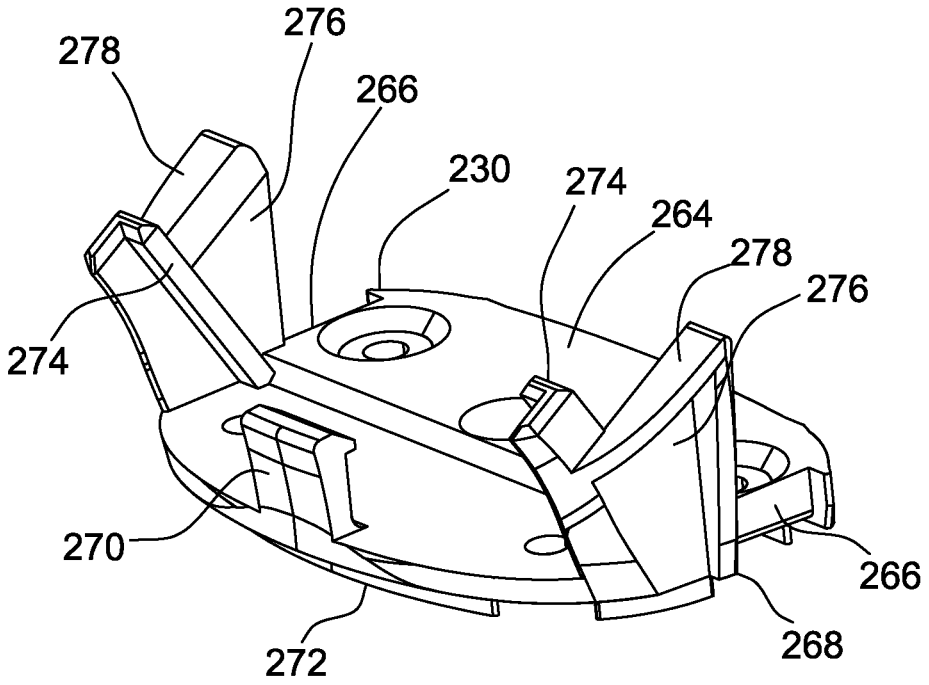
FIG. 11 is a perspective view of a support wall panel of the handle of FIG. 4.
Figure 12:
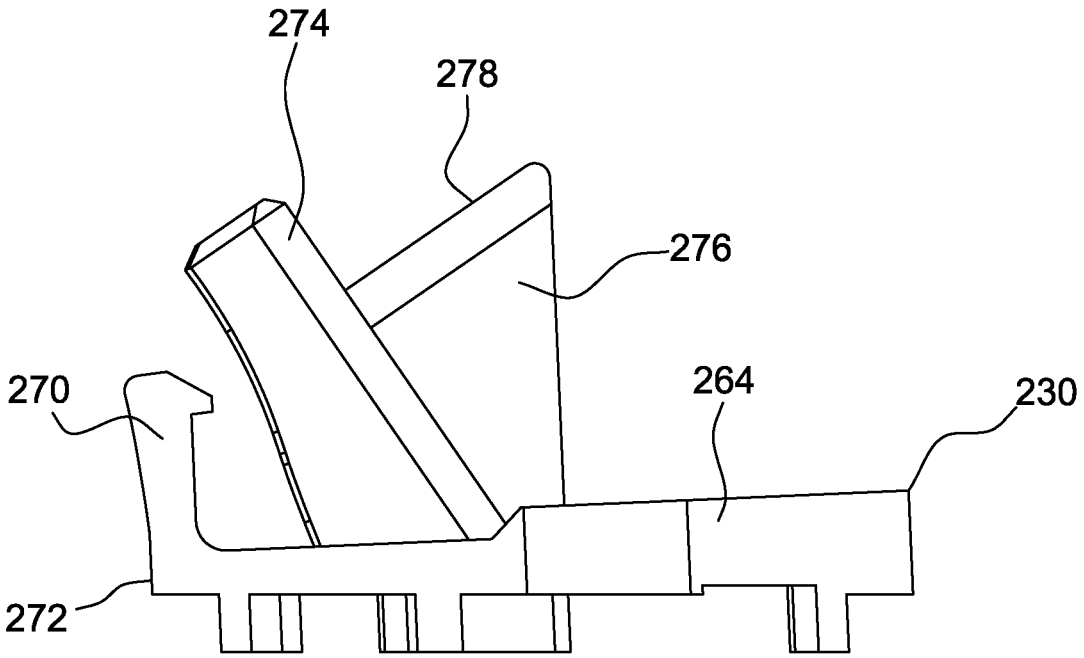
FIG. 12 is a sectional view of the panel of FIG. 11.
Figure 13:
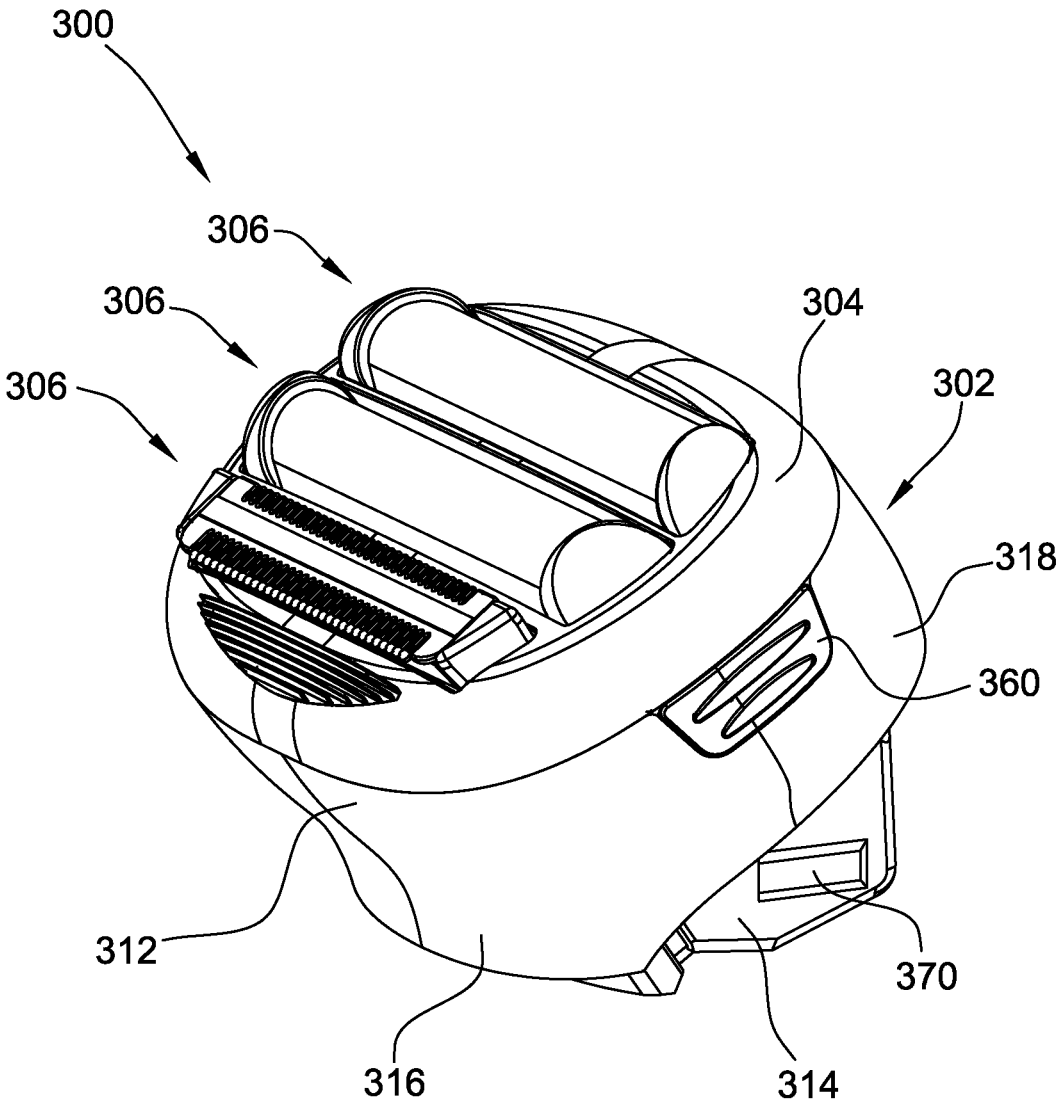
FIG. 13 is a perspective view of a head of the grooming appliance of FIG. 1.
Figure 14:
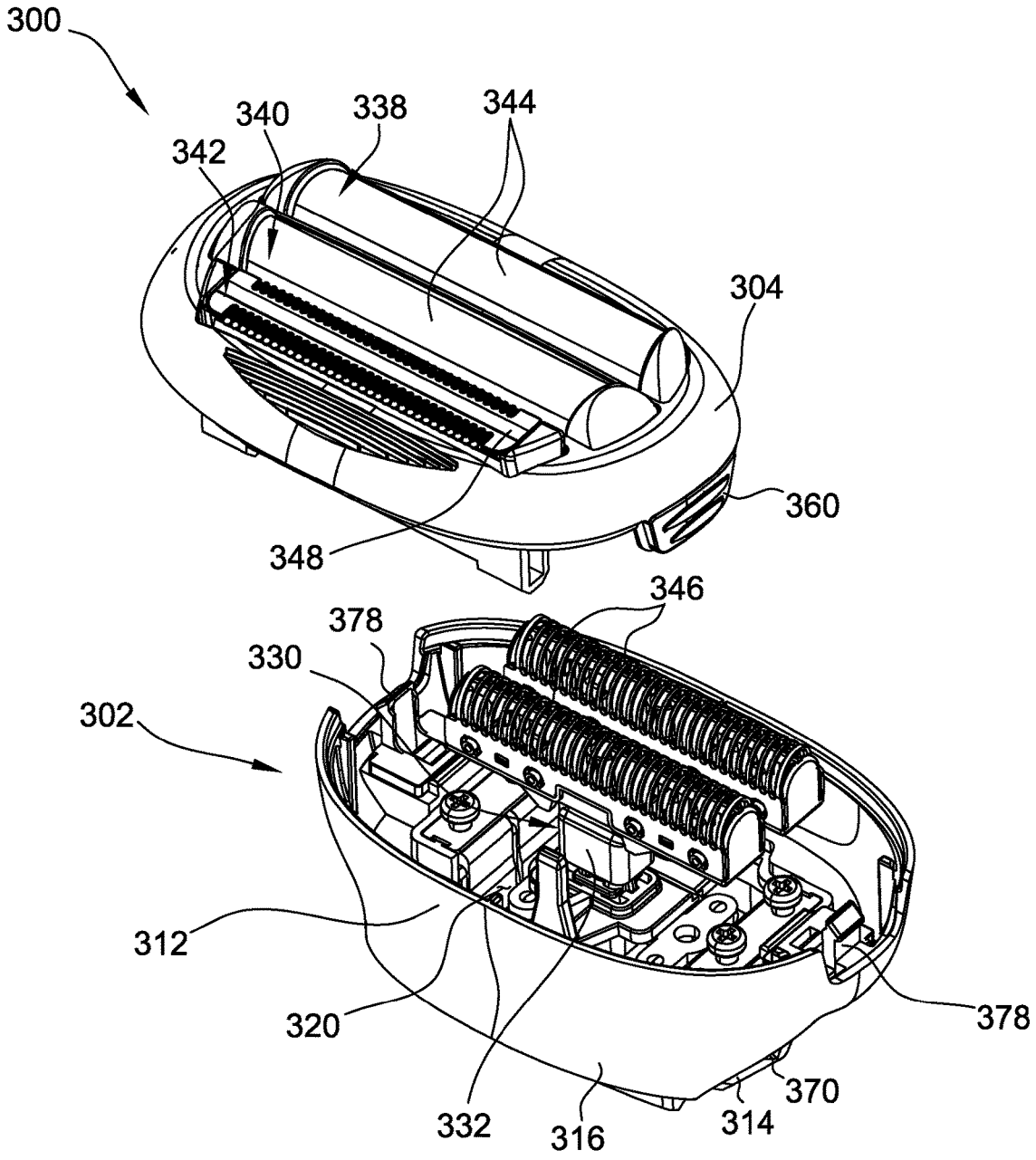
FIG. 14 is an exploded view of the head of FIG. 13.
Figure 15:
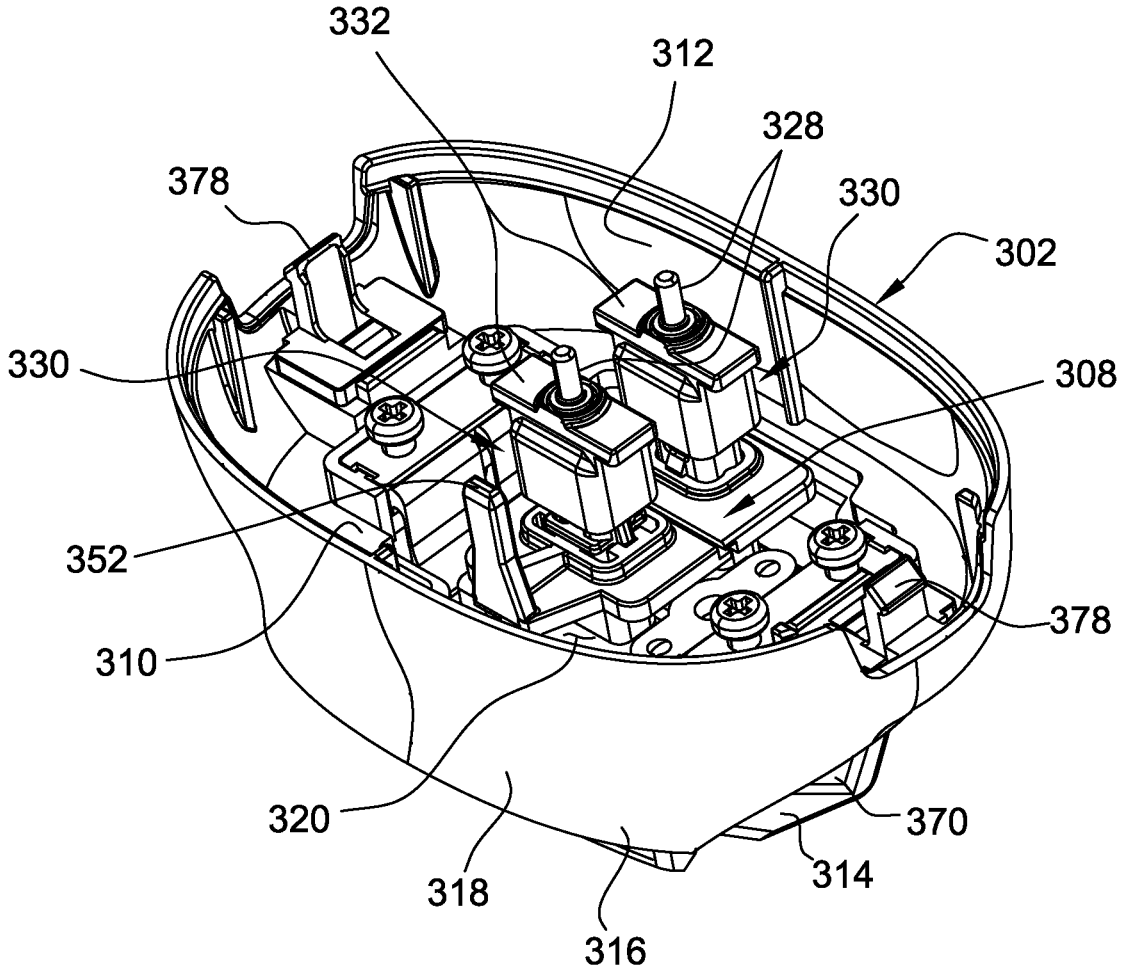
FIG. 15 is a perspective view of a base and drive conversion mechanism subassembly of the head of FIG. 13.

As shown in FIG. 7, when the top panel 230 is attached to the bottom panel 232, each of the tabs 260 is seated alongside (or partly within) one of the cutouts 266 such that an open space is defined therebetween. The strip 244 of the retainer clip 238 is sandwiched between the top panel 230 and the bottom panel 232 of the support wall 228, and each of the clip arms 242 protrudes upward through one of the open spaces such that the clip arms 242 are oriented substantially parallel to the drive shaft axis 224.

Figure 4:
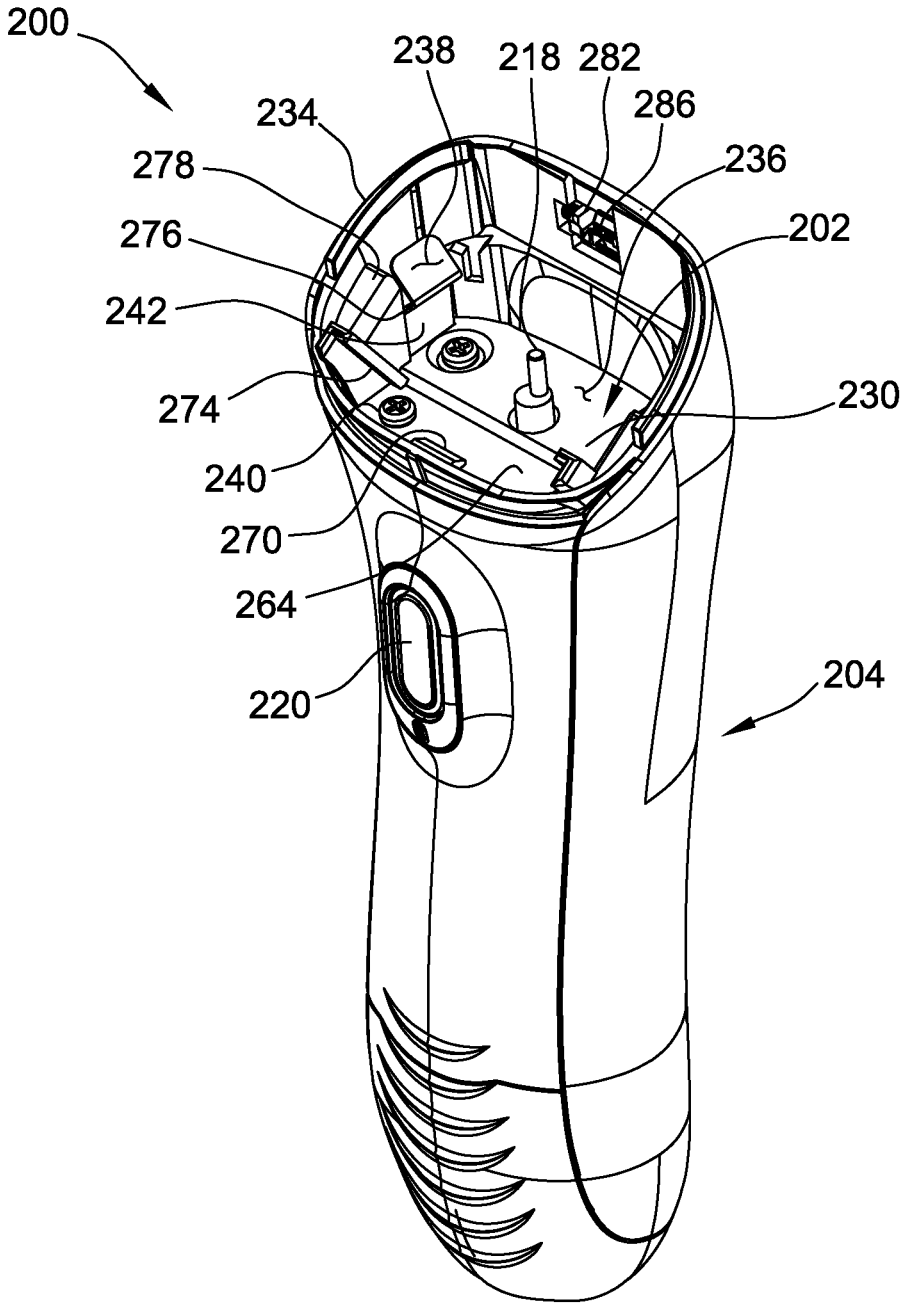
FIG. 4 is a top perspective view of a handle of the grooming appliance of FIG. 1.
Figure 5:
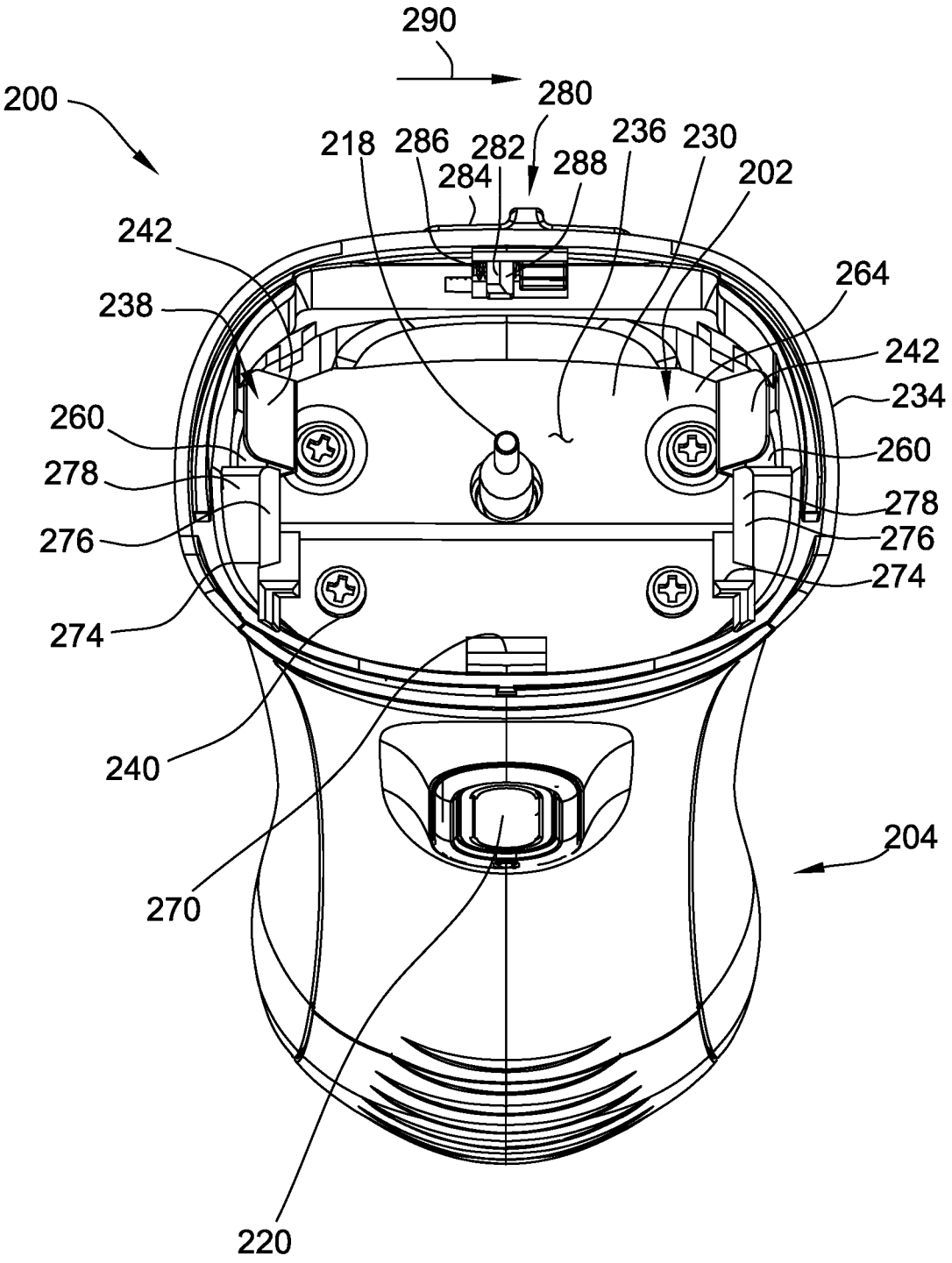
FIG. 5 is a top plan view of the handle of FIG. 4.

In this manner, when the handle 200 is fully assembled as shown in FIGS. 4 and 5, each of the clip arms 242 is positioned on an opposing side of the receptacle 236 and is outwardly flexible against its corresponding tab 260, such that each tab 260 serves as a fulcrum for its corresponding clip arm 242. Each rail 274 and its associated wing 276 are also positioned on one of the opposing sides of the receptacle 236, such that each rail 274 and its associated wing 276 are positioned forward of their corresponding clip arm 242. As such, the catch 270 is positioned at the front of the receptacle 236. This arrangement of the clip arms 242, the catch 270, the rails 274, and the wings 276 within the receptacle 236 facilitates attaching the head 300 to the handle 200 upon insertion of the head 300 into the receptacle 236 as set forth in more detail below.

Notably, the illustrated handle 200 further includes a locking clip (indicated generally at 280) mounted to the rear of the shell 204 so as to extend into the receptacle 236 and be accessible on the exterior of the shell 204 for manual operation by a user of the shaver 100. As used herein, "manual operation" of the locking clip 280 refers to operation of the locking clip 280 by way of gripping or otherwise touching the locking clip 280 by hand. The illustrated locking clip 280 includes: a finger 282 having an upper cam surface 288; and a slide 284 (also shown in FIG. 2) integrally molded with the finger 282 and biased in a locking direction 290 by a spring 286 (i.e., the slide 284 is spring-loaded), which facilitates automatic locking of the head 300 onto the handle 200 when the head 300 is inserted into the receptacle 236.

Referring now to FIGS. 13-21, the illustrated head 300 has a base (indicated generally at 302), a cutter frame 304 detachably mounted on the base 302, at least one cutter assembly (broadly a grooming device) (indicated generally by 306) floatingly supported by the cutter frame 304, and a drive conversion mechanism (indicated generally by 308) mounted within the base 302. While the illustrated base 302 is a single-piece, integrally molded structure, the base 302 may include any suitable quantity of separately molded structures attached to one another in any suitable manner in other embodiments.

The illustrated base 302 has a flange 310, an annular sidewall 312 projecting generally upward of the flange 310, a neck 314 projecting generally downward of the flange 310, and a skirt 316 projecting generally downward of the flange 310 in spaced relation to the neck 314 such that the skirt 316 wraps around at least part of the neck 314 (e.g., the skirt 316 may completely surround the neck 314 as illustrated) and such that the sidewall 312 and the skirt 316 collectively define a substantially continuous exterior surface 318 of the base 302. In this manner, when the drive conversion mechanism 308 is mounted to the flange 310, a hair pocket 320 is defined within the sidewall 312 and above the flange 310 and the drive conversion mechanism 308. Thus, hair cut by the illustrated cutter assemblies 306 (or otherwise removed by another suitable grooming device) collects in the hair pocket 320 on top of the flange 310 and the drive conversion mechanism 308.

Figure 19:
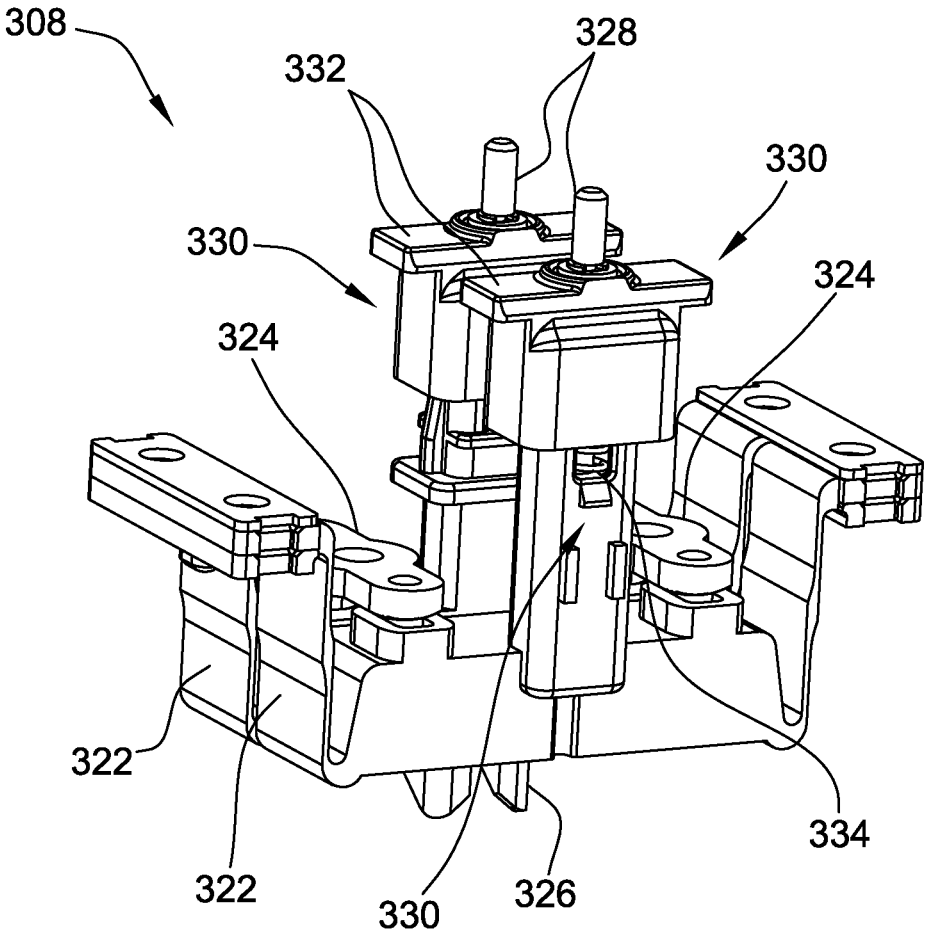
FIG. 19 is a perspective view of a drive conversion mechanism of the subassembly of FIG. 15.
Figure 20:
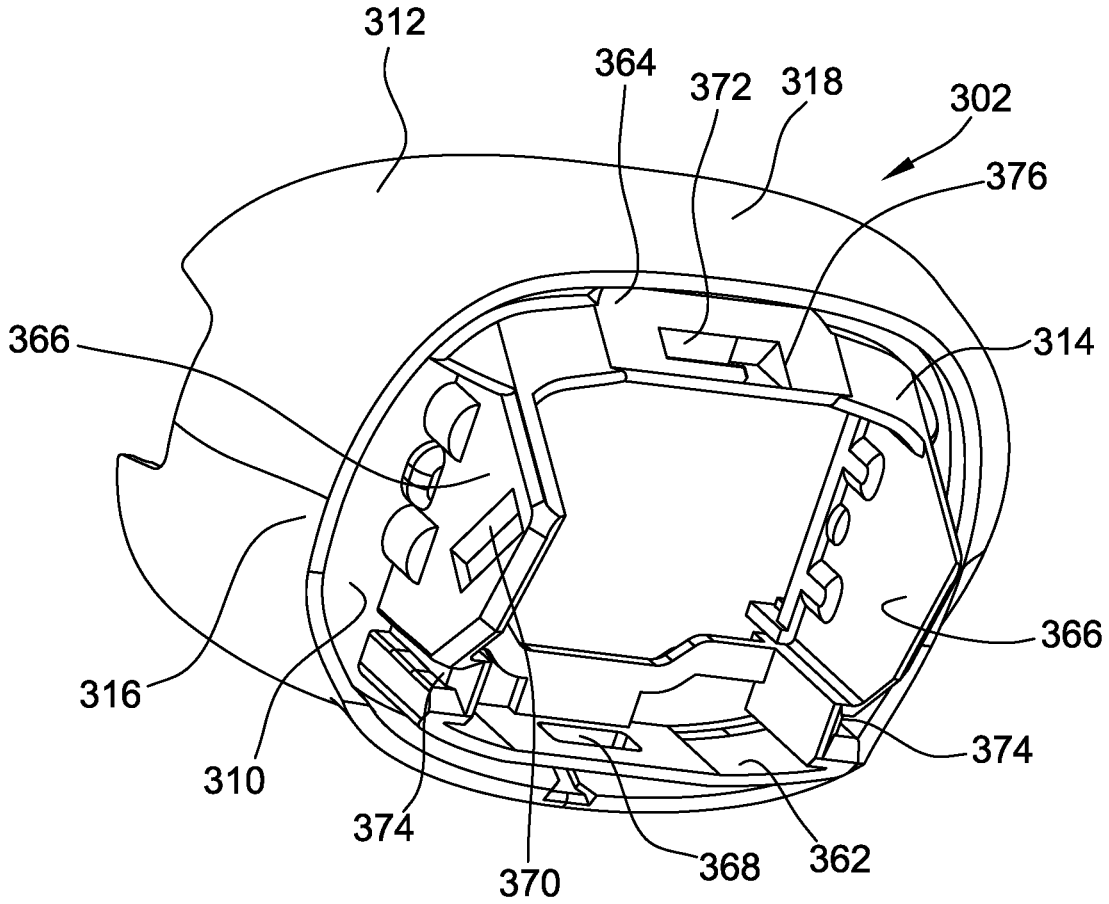
FIG. 20 is a bottom perspective view of a base of the subassembly of FIG. 15.
Figure 21:
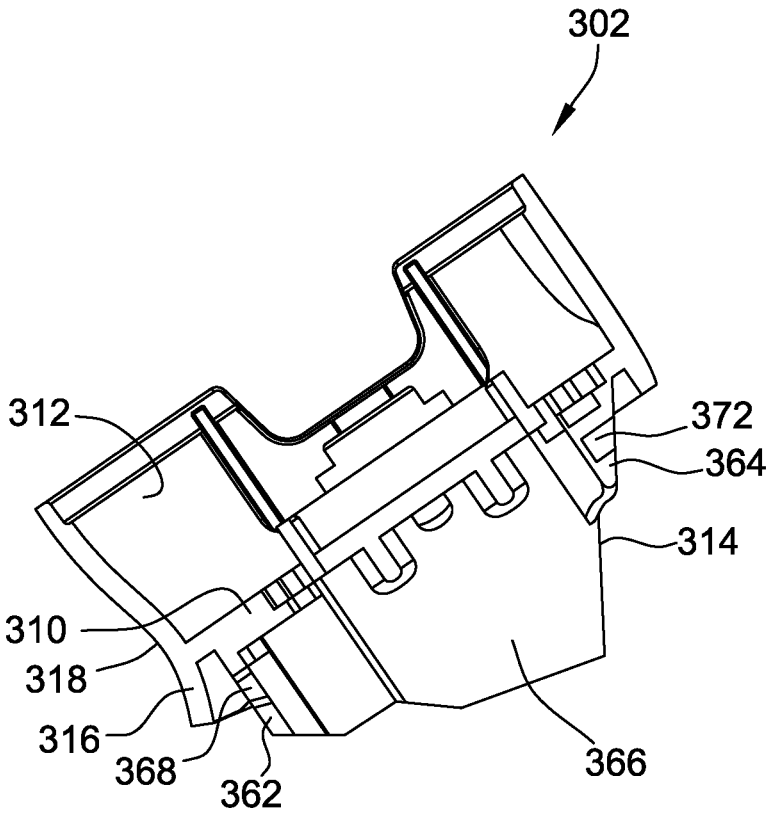
FIG. 21 is a sectional view of the base of FIG. 20.

In the illustrated embodiment, the drive conversion mechanism 308 includes a pair of translatable bridge structures 322 that are interconnected by a pair of pivot members 324 (shown in FIG. 19). One of the bridge structures 322 has a drive coupling 326 projecting generally downward into the neck 314 such that, when the head 300 is attached to the handle 200, the eccentric pin 218 of the drive shaft 216 extends into the drive coupling 326 as set forth in more detail below. Moreover, projecting from each bridge structure 322 is a post 328 and a blade floating mechanism (indicated generally at 330) situated on the post 328. The blade floating mechanism 330 includes a joint 332 and a coil spring 334 (shown in FIG. 19) disposed beneath the joint 332 such that the coil spring 334 circumscribes its respective post 328.

Figure 22:
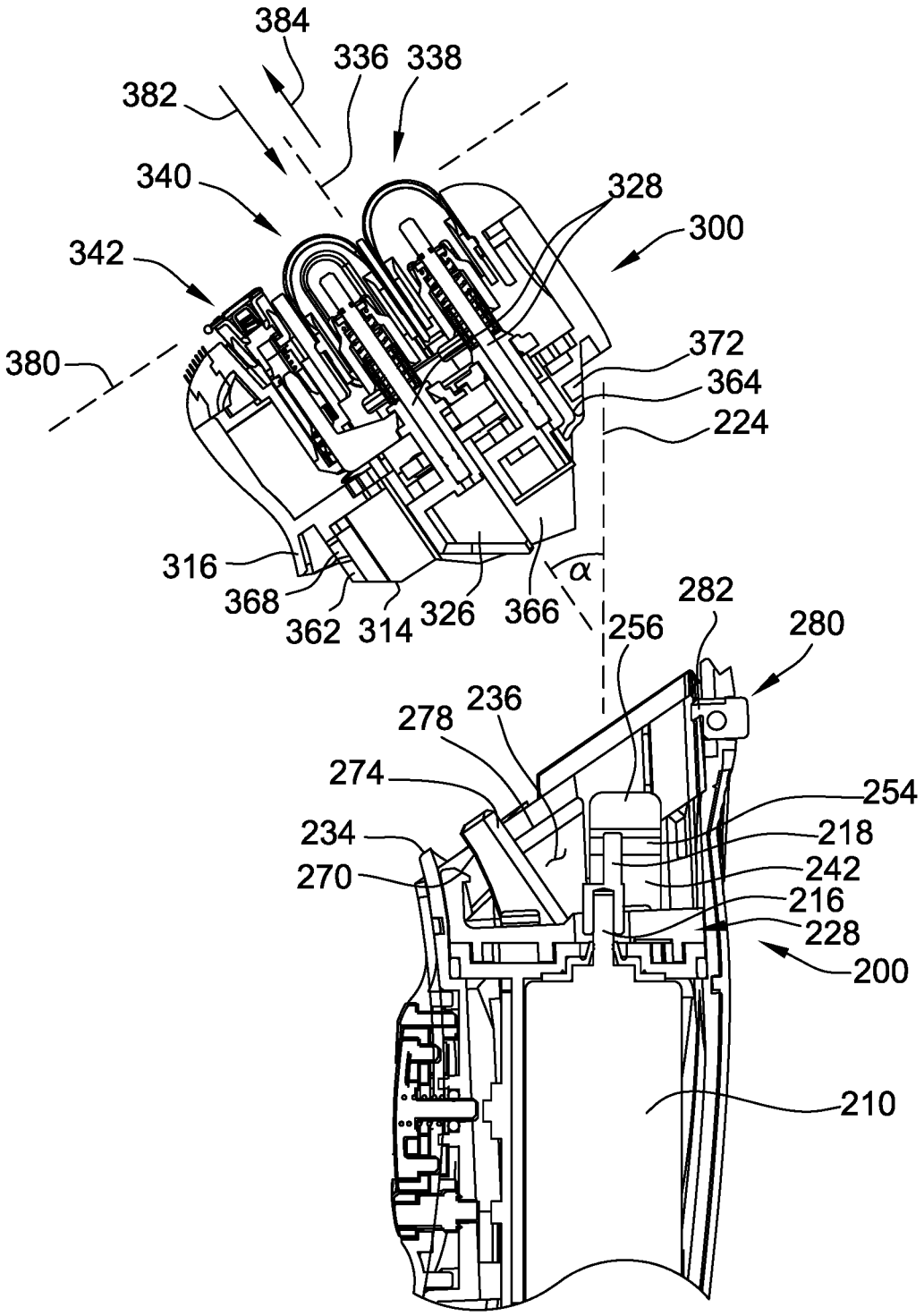
FIG. 22 is a sectional view of the grooming appliance of FIG. 1 when attaching or detaching the head of FIG. 13 and the handle of FIG. 4.

The illustrated head 300 has a head axis 336 oriented substantially perpendicular to a skin-contacting plane 380 that extends across the cutter assemblies 306 of the head 300, as shown in FIG. 22 for example. While the cutter frame 304 and the cutter assemblies 306 are removed from the base 302 in FIG. 16, the skin-contacting plane 380 is nonetheless represented in FIG. 16 for purposes of illustrating the orientation of the head axis 336 relative thereto. In the illustrated embodiment, the head axis 336 is oriented substantially parallel to the drive posts 328 when the drive conversion mechanism 308 is mounted to the base 302. In other suitable embodiments (e.g., epilator embodiments), the orientation of the head axis 336 may not be defined in terms of a skin-contacting plane that extends across cutter assemblies but, rather, in terms of a skin-contacting plane that extends across another suitable grooming device(s) (e.g., in terms of being substantially perpendicular to a skin-contacting plane that extends substantially tangential to the cross-sectional apex of the exposed segment of an epilator barrel).

The illustrated cutter assemblies 306 include a first short-hair cutter assembly (indicated generally by 338), a second short-hair cutter assembly (indicated generally by 340), and a long-hair cutter assembly (indicated generally by 342). Each of the short-hair cutter assemblies 338, 340 includes a foil-type outer blade 344 that is generally U-shaped in cross-section and is floatingly mounted to (and detachable from the base 302 together with) the cutter frame 304. Each of the short-hair cutter assemblies 338, 340 also includes an inner blade 346 (shown in FIG. 14) which is suitably mounted to one of the joints 332 of the drive conversion mechanism 308 so as to be slideable in shearing contact with its respective outer blade 344.

The long-hair cutter assembly 342 includes a pair of toothed blades, namely a movable and stationary blade assembly 348. The blade assembly 348 is floatingly mounted to (and detachable from the base 302 together with) the cutter frame 304 such that the movable blade of the blade assembly 348 is operably connected to one of the posts 328 of the drive conversion mechanism 308 via a linking arm 352 to thereby enable the movable blade of the blade assembly 348 to translate together with one of the inner blades 346. Notably, the cutter frame 304 (which carries the long-hair cutter assembly 342 and the outer blades 344 of the short hair cutter assemblies 338, 340) is detachably mounted on the sidewall 312 of the base 302 by a pair of buttons 360 mounted to the cutter frame 304 for selectively disengaging spring-loaded frame detents 378 mounted to the base 302, thereby enabling the cutter frame 304 to be detached from the sidewall 312 for emptying the hair pocket 320 as desired.

In this manner, when the cutter frame 304 is attached to the base 302 via the frame detents 378, and the head 300 is attached to the handle 200 as set forth below, the eccentric pin 218 is rotatable within the drive coupling 326 to effectively cause the bridge structures 322 to translate in anti-phase to one another. This causes the posts 328, and therefore the joints 332, to likewise translate in anti-phase to one another such that the inner blades 346 shearingly slide against their respective outer blades 344, and such that the movable blade of the blade assembly 348 shearingly slides against the stationary blade of the blade assembly 348.

It is contemplated that, in other embodiments, the drive conversion mechanism 308 may have any suitable configuration that facilitates displacing any suitable quantity of blade(s) in any suitable direction (e.g., the head 300 may have only one cutter assembly 306, and the drive conversion mechanism 308 may have only one bridge structure 322 as a result; or, the grooming appliance may be a rotary shaver, and the drive conversion mechanism may be configured to rotate inner blades of its associated cutter assemblies). Moreover, for grooming appliances other than shavers, the drive conversion mechanism may be configured to operate any suitable grooming device in any suitable manner (e.g., for epilator-type grooming devices, the drive conversion mechanism may be configured to rotate an epilator barrel while also translating at least one pinching plate carried by the epilator barrel).

In the illustrated embodiment, the neck 314 has a forward wall 362, a rearward wall 364, and a pair of sidewalls 366. The forward wall 362 has a forward recess 368 sized to receive the catch 270 of the support wall 228 of the handle 200; the sidewalls 366 each have a side recess 370 sized to receive one of the detent segments 254 of the retainer clip 238 of the handle 200; and the rearward wall 364 has a rearward recess 372 sized to receive the finger 282 of the locking clip 280 of the handle 200. Moreover, each of the side walls 366 also defines a channel 374 positioned generally forward of its respective side recess 370, and sized/oriented to receive a respective one of the rails 274 of the support wall 228 of the handle 200. Notably, the channels 374 are oriented substantially parallel to the head axis 336.

Figure 16:
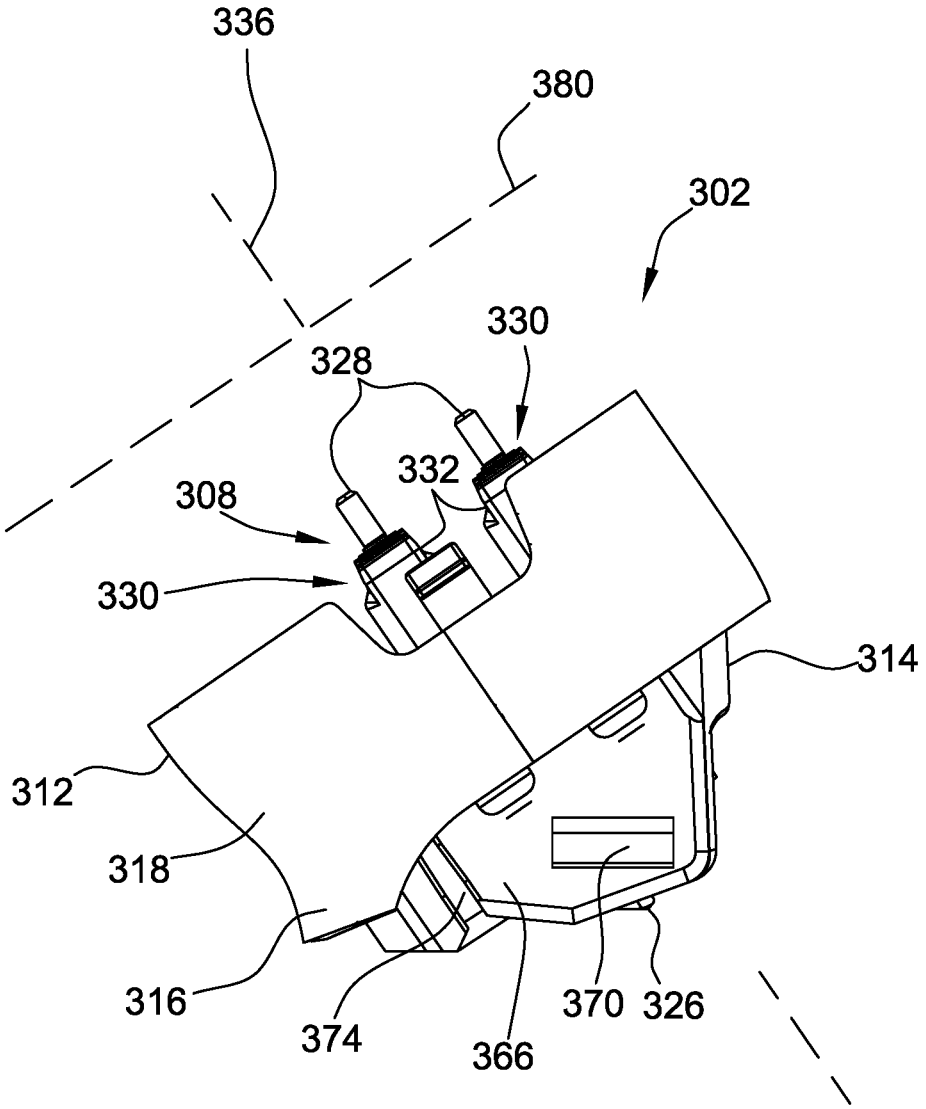
FIG. 16 is a side view of the subassembly of FIG. 15.
Figure 17:
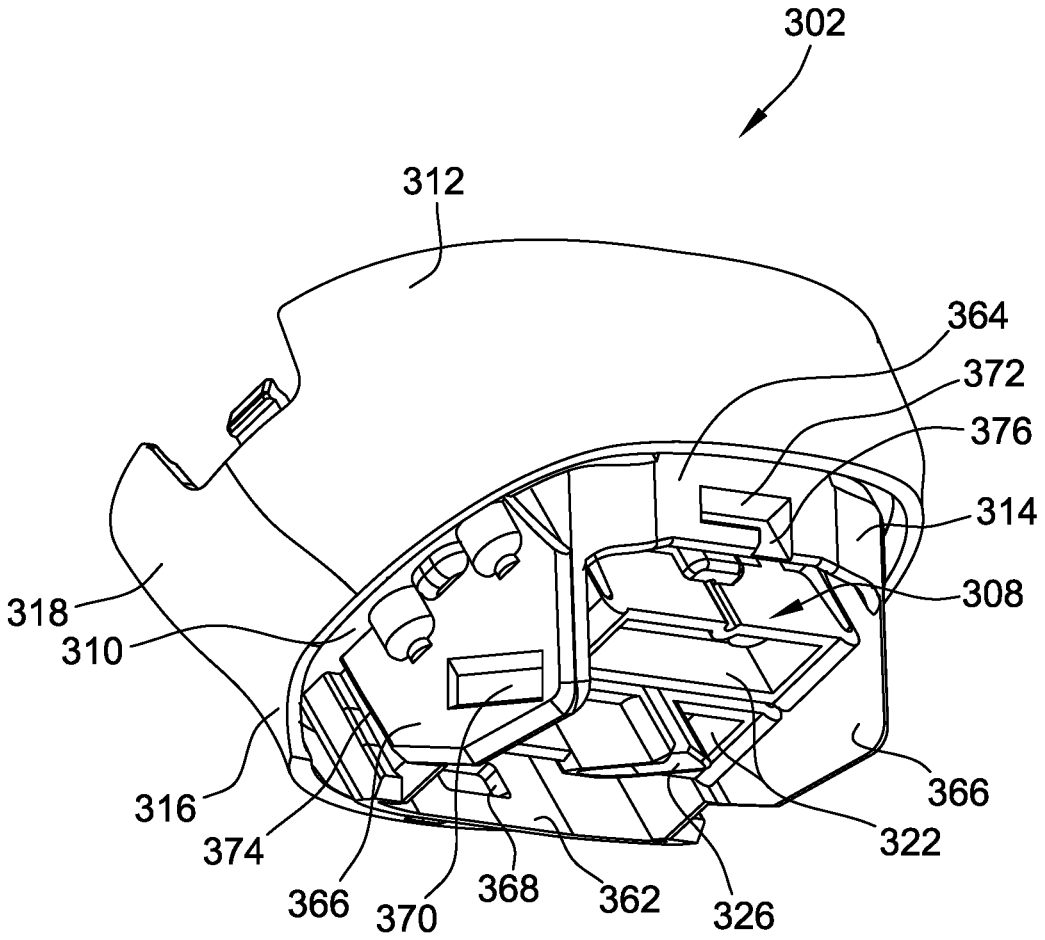
FIG. 17 is a bottom perspective view the subassembly of FIG. 15.
Figure 18:
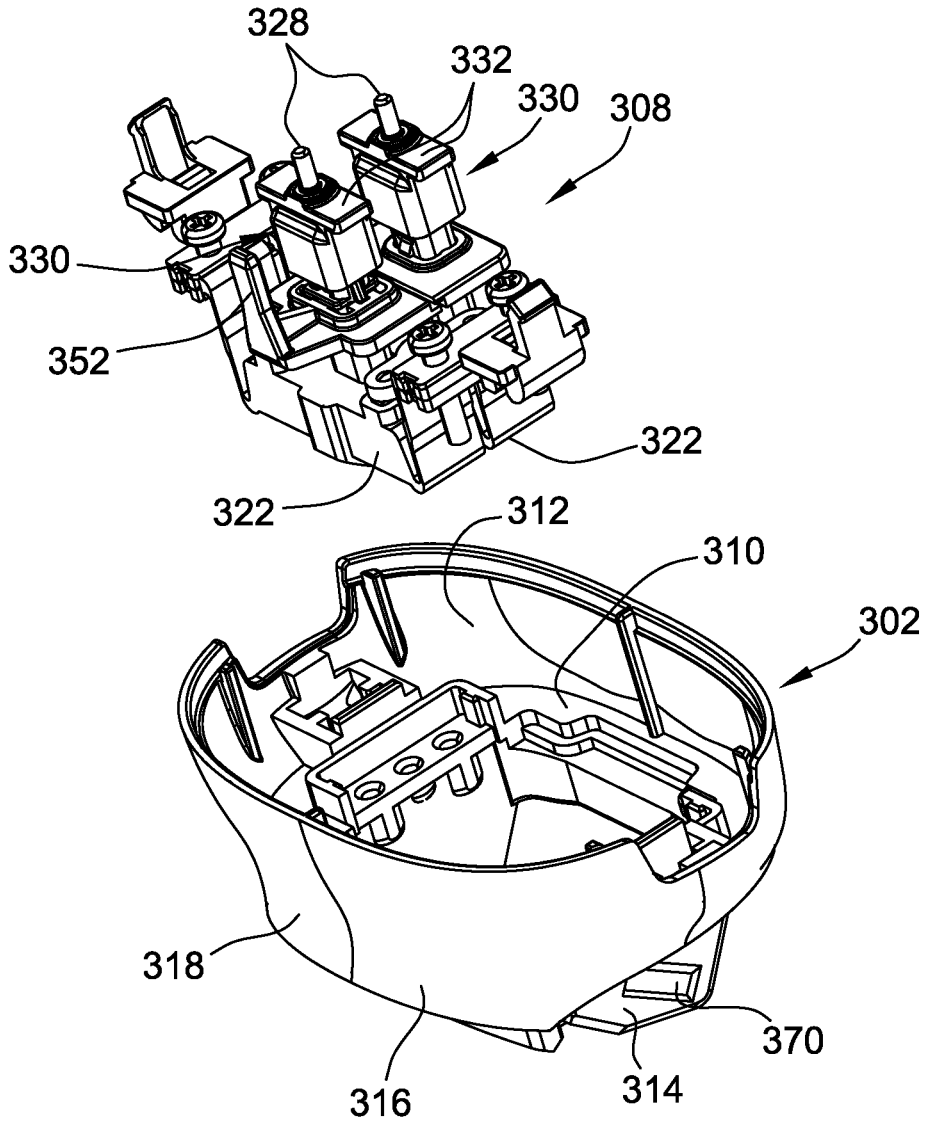
FIG. 18 is an exploded view of the subassembly of FIG. 15.

In the illustrated embodiment, when the head 300 is viewed from the side as shown in FIG. 16, each sidewall 366 of the neck 314 has an area that substantially covers (or substantially entirely overlaps) the drive coupling 326 of the drive conversion mechanism 308 such that the sidewalls 366 facilitate shielding the drive coupling 326 when the head 300 is attached to the handle 200. In other embodiments, the neck 314 of the handle 300 may be configured in any suitable manner that facilities enabling the neck 314 to function as described herein.

With reference now to FIG. 22, when attaching the head 300 to the handle 200, the neck 314 of the head 300 is oriented with the head axis 336 at an oblique angle $\alpha$ relative to (e.g., at about a 35° angle relative to) the drive shaft axis 224 of the handle 200 such that the neck 314 is inserted into the receptacle 236 along an attachment direction 382 that is substantially parallel to the head axis 336 (i.e., the head 300 is inserted into the receptacle 236 along an attachment direction 382 oriented at substantially the angle $\alpha$ relative to the drive shaft axis 224). In this manner, each rail 274 of the support wall 228 is inserted into one of the channels 374 of the neck 314 to effectively guide the insertion of the neck 314 into the receptacle 236 (e.g., to guide the insertion of the eccentric pin 218 into the drive coupling 326). Notably, each of the guide segments 256 of the retainer clip 238 serves to guide (e.g., inwardly deflect or cam) the sidewalls 366 of the neck 314 into alignment with the rails 274 in the event that the sidewalls 366 are slightly misaligned with (or offset relative to) the rails 274 upon initial insertion of the neck 314 into the receptacle 236.

Upon sufficient insertion of the neck 314 into the receptacle 236, the catch 270 engages the forward recess 368 of the neck 314, and each of the clip arms 242 flexibly engages one of the side recesses 370 of the neck 314. Additionally, the locking clip 280 engages the rearward recess 372 of the neck 314, in that the rearward wall 364 of the neck 314 contacts the upper cam surface 288 of the finger 282 and thereby displaces the finger 282 sideways against the bias of the spring 286 until the finger 282 can slide upwardly into a slot 376 (shown in FIGS. 17 and 20) to access (and automatically be biased sideways in the locking direction 290 along) the rearward recess 272 to lockingly retain the neck 314 within the receptacle 236. In this locked position, the skirt 316 is seated on (e.g., is seated flush against) the annular end 234 of the handle 200 such that the neck 314 is completely and cooperatively enclosed within the receptacle 236 by the skirt 316 and the handle 200 to facilitate sealing the receptacle 236 against the infiltration of liquid and other shaving-related debris.

To subsequently detach the head 300 from the handle 200 (e.g., for cleaning the head 300 and/or replacing the head 300 with another head operable using the handle 200), the locking clip 280 is manually operated to displace the slide 284 opposite the locking direction 290 and against the bias of the spring 286, thereby moving the finger 282 along the rearward recess 272 until the finger 282 aligns with the slot 276. Then, the head 300 can be pulled away from the handle 200 such that the finger 282 slides out of slot 276, and such that the applied pulling force overcomes the retention force exerted by the clip arms 242 to forcibly and flexibly disengage the clip arms 242 from the side recesses 370 of the neck 314. The catch 270 also disengages from the forward recess 368.

As the rails 274 of the handle 200 withdraw from the channels 374 of the head 300, the head 300 is caused to displace away from the handle 200 with the head axis 336 maintained in its oblique orientation (e.g., at about 35°) relative to the drive shaft axis 224, such that the rails 274 serve to guide the detachment of the head 300 from the handle 200 along a detachment direction 384 that is substantially parallel to the head axis 336 (i.e., the head 300 is withdrawn from the receptacle 236 along a detachment direction 384 oriented at substantially the angle $\alpha$ relative to the drive shaft axis 224).

In this manner, the head 300 can be attached and automatically locked onto the handle 200 by merely inserting (or pushing) the head 300 into the receptacle 236, but the head 300 cannot be detached from the handle 200 by merely pulling the head 300 from the handle 200. Rather, the locking clip 280 must be manually operated and, thereby, disengaged before pulling of the head 300 from the handle 200 is permitted.

In accordance with the description above, each of the handle 200 and the head 300 is said to have an attachment structure that connects the head 300 to the handle 200. The attachment structure of the handle 200 in particular is said to include a plurality of attachment members each of a different type (e.g., the catch 270 being a first type of attachment member, each clip arm 242 being a second type of attachment member, and/or the locking clip 280 being a third type of attachment member). Notably, the attachment structure of the handle 200 may have any suitable plurality of attachment members in any suitable combination (e.g., two catches 270, one clip arm 242, and one locking clip 280) arranged at least partially within the receptacle 236 in any suitable manner.

As used herein, the term "different type" (or "different types") in relation to the attachment members refers to the attachment members comparatively being of different shapes, being of different sizes, and/or functioning in a fundamentally different manner to engage and/or disengage the head 300. In one example of attachments members functioning in a fundamentally different manner, a first attachment member may automatically engage and/or disengage the head 300 upon insertion and/or withdrawal of the head 300 relative to the receptacle 236, while a second attachment member may require manual operation to engage and/or disengage the head 300 upon insertion and/or withdrawal of the head 300 relative to the receptacle 236. In another example of attachment members functioning in a fundamentally different manner, a first attachment member may resiliently flex to automatically engage and/or disengage the head 300, while a second attachment member may remain rigid to automatically engage and/or disengage the head 300. Other ways of functioning in a fundamentally different manner are also contemplated without departing from the scope of this disclosure.

In addition to providing improved retention of the head 300 on the handle 200, the attachment structures set forth herein also facilitate attaching the head 300 to the handle 200 in a manner that makes for a more comfortable shaving experience, while also facilitating a reduction in the complexity of the drive structure within the handle 200. In the illustrated embodiment, the head 300 is attachable to, and detachable from, the handle 200 along opposite directions 382, 384 which are both oblique relative to the drive shaft axis 224. Because the head 300 is attachable and detachable in this manner, the drive structure of the handle 200 can in some embodiments be configured without gearing and/or without jointed drive shaft segments that would otherwise be needed to achieve such oblique head attachment/detachment directions 382, 384. The drive structure of the handle 200 is therefore simplified in the sense that the drive structure includes only the motor 210, the single, unitary drive shaft 216 (which directly interfaces with the motor 210), and the eccentric pin 218 which is mounted at the tip 226 of the drive shaft 216.

When introducing elements of the present invention or the preferred embodiment(s) thereof, the articles "a", "an", "the", and "said" are intended to mean that there are one or more of the elements. The terms "comprising," "including", and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A handheld electric shaver comprising:

a head having at least one outer cutter defining a skin-contacting plane of the shaver, and a head axis oriented substantially perpendicular to the skin-contacting plane of the shaver, the head including at least one inner cutter moveable relative to the outer cutter in operation of the shaver; and a handle onto which the head is detachably mountable, the handle having a motor, a drive shaft operatively connected to the motor and defining a drive shaft axis, and a receptacle configured to receive at least a portion of the head therein upon mounting the head on the handle such that the drive shaft protrudes into the receptacle for operative connection with the at least one inner cutter of the head, the handle and the head being configured relative to each other such that the head is insertable into the receptacle along an insertion direction wherein the insertion direction is substantially parallel to the head axis and oblique relative to the drive shaft axis, wherein at least one of the handle and the head has a guide rail having at least two surfaces, wherein the other of the at least one of the handle and the head has a corresponding channel for slidably receiving the guide rail within the channel such that the two surfaces extend along the insertion direction within the channel to guide the head into the receptacle along the insertion direction.

2. The shaver set forth in claim 1, wherein the head includes a neck depending therefrom and insertable into the receptacle when the head is mounted on the handle.

3. The shaver set forth in claim 2, wherein the head further includes a skirt that circumferentially surrounds the neck in spaced relationship therewith.

4. The shaver set forth in claim 1, wherein the head has a hair pocket for collecting hair cut by the at least one inner cutter.

5. The shaver set forth in claim 1, wherein the drive shaft includes an eccentric pin and the head includes a drive coupling that engages the eccentric pin when the head is mounted on the handle to provide the operative connection between the drive shaft and the at least one inner cutter of the head.

6. The handheld electric shaver as set forth in claim 1, wherein the head includes a base, the at least one inner cutter and the at least one outer cutter forming a cutter assembly supported by the base, the base including a neck and a skirt formed integrally with the neck, the skirt at least partially circumferentially surrounding the neck in spaced relationship therewith, and wherein the receptacle is configured to receive the neck therein when the handle is mounted on the head, the handle having an end against which the skirt is seated when the neck is inserted into the receptacle whereby the neck is enclosed within the receptacle when the handle is mounted on the head.

7. The handheld electric shaver as set forth in claim 6, wherein the skirt completely circumferentially surrounds the neck.

8. The handheld electric shaver as set forth in claim 7, wherein the end of the handle is annular.

9. The handheld electric shaver as set forth in claim 8, wherein the head and the handle are configured to sealingly enclose the neck within the receptacle when the head is mounted on the handle.

10. The handheld electric shaver as set forth in claim 6, wherein the head includes a drive conversion mechanism disposed at least in part within the neck and operatively connected to the at least one inner cutter, the drive conversion mechanism configured to operatively engage the drive shaft to provide the operative connection between the drive shaft and the at least one inner cutter of the head when the head is mounted on the handle.

11. The handheld electric shaver as set forth in claim 10, wherein the drive shaft includes an eccentric pin and the drive conversion mechanism includes a drive coupling that receives the eccentric pin.

12. The handheld electric shaver as set forth in claim 6, wherein the head defines a hair pocket for collecting hair cut by the cutter assembly.

* * * * *